US012723590B2

(12) United States Patent
Henton et al.

(10) Patent No.: US 12,723,590 B2
(45) Date of Patent: Sep. 1, 2026

(54) STICK PUMP ASSEMBLY

(71) Applicant: MILWAUKEE ELECTRIC TOOL CORPORATION, Brookfield, WI (US)

(72) Inventors: Nolan J. Henton, Milwaukee, WI (US); Justin Miller, Richfield, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 0 days.

(21) Appl. No.: 18/931,638

(22) Filed: Oct. 30, 2024

(65) Prior Publication Data

US 2025/0052247 A1 Feb. 13, 2025

Related U.S. Application Data

(63) Continuation of application No. 18/359,108, filed on Jul. 26, 2023, now Pat. No. 12,163,524, which is a (Continued)

(51) Int. Cl.
*F04D 13/06* (2006.01)
*F04D 13/08* (2006.01)

(Continued)

(52) U.S. Cl.
CPC ..... *F04D 13/068* (2013.01); *F04D 13/08* (2013.01); *F04D 13/086* (2013.01); *F04D 13/10* (2013.01);

(Continued)

(58) Field of Classification Search
CPC .... F04D 29/445; F04D 29/406; F04D 29/628; F04D 29/5806; F04D 13/10;

(Continued)

(56) References Cited

U.S. PATENT DOCUMENTS 1,974,678 A 9/1934 LaFont
2,363,419 A 11/1944 Howard (Continued)

FOREIGN PATENT DOCUMENTS

CN 2349387 Y 11/1999
CN 2578572 Y 10/2003

(Continued)

OTHER PUBLICATIONS

Extended European Search Report for Application No. 21883707.8 dated Jan. 20, 2025 (9 pages).

(Continued)

*Primary Examiner* — Peter J Bertheaud
(74) *Attorney, Agent, or Firm* — Michael Best & Friedrich LLP

(57) ABSTRACT

A stick pump assembly includes a tube having a first end, a second end, and an axis extending through the first end and the second end. The stick pump assembly also includes a pump having a motor and an impeller. The pump has an inlet adjacent the first end and in fluid communication with the tube. The stick pump assembly also includes a chamber surrounding the pump. The chamber is fluidly separated from the motor. The stick pump assembly also includes a handle having an outlet adjacent the second end and in fluid communication with the tube, a receptacle configured to receive a battery pack, and a grip formed by an outer periphery of the handle. The grip is configured to be grasped by a user during operation of the stick pump assembly. The outlet and the grip are positioned along the axis between the tube and the receptacle.

19 Claims, 9 Drawing Sheets

Related U.S. Application Data continuation of application No. 17/505,351, filed on Oct. 19, 2021, now Pat. No. 11,808,268.

(60) Provisional application No. 63/158,049, filed on Mar. 8, 2021, provisional application No. 63/093,439, filed on Oct. 19, 2020.

(51) Int. Cl.

| | |
|---|---|
| ***F04D 13/10*** | (2006.01) |
| ***F04D 15/02*** | (2006.01) |
| ***F04D 29/043*** | (2006.01) |
| ***F04D 29/40*** | (2006.01) |
| ***F04D 29/42*** | (2006.01) |
| ***F04D 29/44*** | (2006.01) |
| ***F04D 29/52*** | (2006.01) |
| ***F04D 29/58*** | (2006.01) |
| ***F04D 29/60*** | (2006.01) |
| ***F04D 29/62*** | (2006.01) |
| ***F04D 29/70*** | (2006.01) |

(52) U.S. Cl.

CPC ..... *F04D 15/0218* (2013.01); *F04D 29/043* (2013.01); *F04D 29/406* (2013.01); *F04D 29/426* (2013.01); *F04D 29/4293* (2013.01); *F04D 29/445* (2013.01); *F04D 29/528* (2013.01); *F04D 29/5806* (2013.01); *F04D 29/605* (2013.01); *F04D 29/628* (2013.01); *F04D 29/708* (2013.01)

(58) Field of Classification Search

CPC .. F04D 29/426; F04D 13/068; F04D 15/0218; F04D 13/08; F04D 29/605; F04D 29/4293; F04D 13/086; F04D 29/708

See application file for complete search history.

(56) References Cited

U.S. PATENT DOCUMENTS

| | | | |
|---|---|---|---|
| 2,369,440 | A | 2/1945 | Curtis |
| 3,267,868 | A | 8/1966 | Page |
| 3,371,613 | A | 3/1968 | Dahlgren et al. |
| 3,652,186 | A | 3/1972 | Carter |
| 3,653,785 | A | 4/1972 | Dahlgren et al. |
| 3,733,151 | A | 5/1973 | Timmons et al. |
| 3,748,066 | A | 7/1973 | Sully et al. |
| 3,803,432 | A | 4/1974 | Laing |
| 3,850,550 | A | 11/1974 | Kaessen |
| 3,854,848 | A | 12/1974 | Laing |
| 3,915,351 | A | 10/1975 | Kiralfy |
| 3,960,467 | A | 6/1976 | Zsuppan |
| 4,002,936 | A | 1/1977 | Laing |
| 4,035,108 | A | 7/1977 | Laing |
| 4,065,232 | A | 12/1977 | Stratienko |
| 4,134,711 | A | 1/1979 | Ivins et al. |
| 4,181,475 | A | 1/1980 | Stahl |
| 4,218,195 | A | 8/1980 | Shure |
| 4,289,456 | A | 9/1981 | Ishihara |
| 4,488,852 | A | 12/1984 | Ivins et al. |
| 4,614,482 | A | 9/1986 | Gaffal |
| 4,632,643 | A | 12/1986 | Nielsen |
| 4,747,757 | A | 5/1988 | Haentjens |
| 5,055,006 | A | 10/1991 | Kobayashi et al. |
| 5,134,328 | A | 7/1992 | Johnatakis et al. |
| 5,250,863 | A | 10/1993 | Brandt |
| 5,419,270 | A | 5/1995 | Berge |
| 5,480,290 | A | 1/1996 | Zelder |
| 5,571,001 | A | 11/1996 | Fukuda et al. |
| 5,659,214 | A | 8/1997 | Guardiani et al. |
| 5,674,057 | A | 10/1997 | Guardiani et al. |
| 5,692,886 | A | 12/1997 | Kobayashi et al. |
| 5,823,751 | A | 10/1998 | Sjoblom et al. |
| 6,179,558 | B1 | 1/2001 | Eastman, III et al. |
| 6,390,780 | B1 | 5/2002 | Batchelder et al. |
| 6,447,261 | B1 | 9/2002 | McCook |
| 6,655,932 | B1 | 12/2003 | Stinessen et al. |
| 7,264,449 | B1 | 9/2007 | Harned et al. |
| 7,341,436 | B2 | 3/2008 | Andrews |
| 7,371,045 | B2 | 5/2008 | Patel et al. |
| 7,701,106 | B2 | 4/2010 | Yuratich |
| 8,226,385 | B2 | 7/2012 | Wendel et al. |
| 8,491,277 | B2 | 7/2013 | Kawabata et al. |
| 8,523,540 | B2 | 9/2013 | Eide et al. |
| 8,784,077 | B1 | 7/2014 | Ray |
| 8,807,970 | B2 | 8/2014 | Schlenhoff et al. |
| 8,899,054 | B2 | 12/2014 | Jankowski et al. |
| 9,255,577 | B2 | 2/2016 | Zhai et al. |
| 9,297,386 | B2 | 3/2016 | Bottan |
| 9,394,917 | B2 | 7/2016 | Jankowski et al. |
| 9,660,497 | B2 | 5/2017 | Ladd |
| 9,797,402 | B2 | 10/2017 | Jankowski et al. |
| 9,863,424 | B2 | 1/2018 | Homstvedt |
| 10,030,670 | B2 | 7/2018 | Bratthäll |
| 10,087,938 | B2 | 10/2018 | Dahouk et al. |
| 10,502,234 | B2 | 12/2019 | Zhu et al. |
| 10,801,309 | B2 | 10/2020 | Cunningham |
| 11,808,268 | B2 | 11/2023 | Henton et al. |
| 12,163,524 | B2 * | 12/2024 | Henton ..... F04D 29/605 |
| 2005/0135945 | A1 | 6/2005 | Nelson et al. |
| 2006/0039800 | A1 * | 2/2006 | Saunders ..... B63B 13/00 417/234 |
| 2007/0025866 | A1 | 2/2007 | Douyama et al. |
| 2008/0080988 | A1 | 4/2008 | Wahl et al. |
| 2009/0136363 | A1 | 5/2009 | Stiles, Jr. et al. |
| 2013/0177450 | A1 | 7/2013 | Magnusson |
| 2013/0285330 | A1 | 10/2013 | Kawabata et al. |
| 2013/0319956 | A1 | 12/2013 | Tetzlaff et al. |
| 2016/0312784 | A1 | 10/2016 | Patel |
| 2018/0135633 | A1 | 5/2018 | Mayleben |
| 2018/0372122 | A1 | 12/2018 | Wang |
| 2019/0003479 | A1 | 1/2019 | Dahouk et al. |
| 2019/0048875 | A1 | 2/2019 | Mayleben |
| 2019/0072096 | A1 | 3/2019 | Mei et al. |
| 2019/0154039 | A1 | 5/2019 | Wang |
| 2021/0108641 | A1 * | 4/2021 | Arkwright ..... F04D 29/605 |

FOREIGN PATENT DOCUMENTS

| | | | |
|---|---|---|---|
| CN | 2641350 | Y | 9/2004 |
| CN | 2721931 | Y | 8/2005 |
| CN | 1804406 | A | 7/2006 |
| CN | 201159179 | Y | 12/2008 |
| CN | 101413517 | A | 4/2009 |
| CN | 201273288 | Y | 7/2009 |
| CN | 201650776 | U | 11/2010 |
| CN | 201818506 | U | 5/2011 |
| CN | 201818507 | U | 5/2011 |
| CN | 202545276 | U | 11/2012 |
| CN | 103062135 | A | 4/2013 |
| CN | 102270902 | B | 5/2013 |
| CN | 203441826 | U | 2/2014 |
| CN | 103629144 | A | 3/2014 |
| CN | 203641072 | U | 6/2014 |
| CN | 203691159 | U | 7/2014 |
| CN | 204041482 | U | 12/2014 |
| CN | 204099230 | U | 1/2015 |
| CN | 104343696 | A | 2/2015 |
| CN | 104454560 | A | 3/2015 |
| CN | 104533805 | A | 4/2015 |
| CN | 204239274 | U | 4/2015 |
| CN | 104728125 | A | 6/2015 |
| CN | 204386901 | U | 6/2015 |
| CN | 104747460 | A | 7/2015 |
| CN | 103615394 | B | 1/2016 |
| CN | 103967844 | B | 3/2016 |
| CN | 105386984 | A | 3/2016 |
| CN | 205136048 | U | 4/2016 |
| CN | 205225768 | U | 5/2016 |
| CN | 105952657 | A | 9/2016 |
| CN | 106050682 | A | 10/2016 |
| CN | 104329267 | B | 11/2016 |
| CN | 106089744 | A | 11/2016 |

(56) References Cited

FOREIGN PATENT DOCUMENTS

| | | | |
|---|---|---|---|
| CN | 106351852 | A | 1/2017 |
| CN | 106593894 | A | 4/2017 |
| CN | 106593895 | A | 4/2017 |
| CN | 106593896 | A | 4/2017 |
| CN | 106837807 | A | 6/2017 |
| CN | 106930957 | A | 7/2017 |
| CN | 106949071 | A | 7/2017 |
| CN | 107100859 | A | 8/2017 |
| CN | 107143504 | A | 9/2017 |
| CN | 107503950 | A | 12/2017 |
| CN | 107687423 | A | 2/2018 |
| CN | 107781174 | A | 3/2018 |
| CN | 107869481 | A | 4/2018 |
| CN | 107893782 | A | 4/2018 |
| CN | 108799143 | A | 11/2018 |
| CN | 109372758 | A | 2/2019 |
| CN | 109538498 | A | 3/2019 |
| CN | 109617318 | A | 4/2019 |
| CN | 109681434 | A | 4/2019 |
| CN | 107725403 | B | 8/2019 |
| CN | 110118184 | A | 8/2019 |
| CN | 110273842 | A | 9/2019 |
| CN | 110285073 | A | 9/2019 |
| CN | 209523889 | U | 10/2019 |
| CN | 110529398 | A | 12/2019 |
| CN | 210290180 | U | 4/2020 |
| CN | 107747546 | B | 5/2020 |
| CN | 109595181 | B | 7/2020 |
| DE | 1190794 | B | 4/1965 |
| DE | 1488461 | A1 | 4/1969 |
| DE | 1703433 | A1 | 12/1971 |
| DE | 2507846 | A1 | 9/1975 |
| DE | 2552590 | A1 | 6/1977 |
| DE | 2743112 | A1 | 4/1979 |
| DE | 3239601 | A1 | 5/1983 |
| DE | 3609311 | A1 | 10/1987 |
| DE | 8810955 | U1 | 4/1989 |
| DE | 9106820 | U1 | 7/1991 |
| DE | 4103154 | A1 | 8/1992 |
| DE | 9408924 | U1 | 8/1994 |
| DE | 4430764 | A1 | 3/1996 |
| DE | 29520422 | U1 | 4/1997 |
| DE | 10208688 | B4 | 11/2005 |
| DE | 102005034341 | A1 | 1/2007 |
| DE | 102005056309 | B4 | 12/2007 |
| DE | 202019101723 | U1 | 6/2020 |
| DE | 102019113948 | B3 | 10/2020 |
| EP | 0013869 | A1 | 8/1980 |
| EP | 0043162 | A1 | 1/1982 |
| EP | 0178087 | A1 | 4/1986 |
| EP | 0704627 | B1 | 11/1997 |
| EP | 0864759 | A2 | 9/1998 |
| EP | 0990800 | A1 | 4/2000 |
| EP | 0943810 | B1 | 1/2004 |
| EP | 1260714 | B1 | 11/2006 |
| JP | 2001032788 | A | 2/2001 |
| KR | 2019900003838 | Y1 | 5/1990 |
| WO | WO0077341 | A1 | 12/2000 |
| WO | WO0194786 | A1 | 12/2001 |
| WO | WO2011019334 | A1 | 2/2011 |
| WO | WO2015149659 | A1 | 10/2015 |
| WO | WO2019149390 | A1 | 8/2019 |
| WO | WO2019149840 | A1 | 8/2019 |
| WO | WO2019149841 | A1 | 8/2019 |

OTHER PUBLICATIONS

Reed Manufacturing, "Pump Stick™, " product flyer dated Aug. 2019 (2 pages).

Reed Manufacturing, "Pump Stick® Cordless Power Water Pump Intro—Reed Manufacturing," <https://www.youtube.com/watch?v=-Av0dkDRPPw> YouTube video dated Feb. 28, 2019.

International Search Report and Written Opinion for Application No. PCT/US2021/055637 dated Feb. 8, 2022 (11 pages).

Chinese Patent Office Action for related Application No. 202190000810.0 dated Nov. 16, 2023 (4 pages including statement of relevance).

* cited by examiner

STICK PUMP ASSEMBLY

CROSS-REFERENCE TO RELATED APPLICATIONS

This application is a continuation of U.S. patent application Ser. No. 18/359,108, filed Jul. 26, 2023, now U.S. Pat. No. 12,163,524, which is a continuation of U.S. patent application Ser. No. 17/505,351, filed Oct. 19, 2021, now U.S. Pat. No. 11,808,268, which claims priority to U.S. Provisional Patent Application No. 63/093,439, filed Oct. 19, 2020, and to U.S. Provisional Patent Application No. 63/158,049, filed Mar. 8, 2021, the entire contents of each of which are incorporated herein by reference.

FIELD

The invention generally relates to pumps and, more particularly, to battery-powered pump assemblies for pumping water and other fluids.

SUMMARY

In one independent embodiment, a stick pump assembly includes a tube having a first end, a second end, and an axis extending through the first and second ends, the tube accommodating fluid to flow therethrough; a pump including a motor and an impeller, the pump having an inlet adjacent the first end and in fluid communication with the tube; a handle having an outlet adjacent the second end and in fluid communication with the tube, the handle including a receptacle configured to receive a battery pack; and a filter assembly supported by the pump and in fluid communication with the inlet. Fluid flows into the stick pump assembly though the inlet, around the motor, through the tube, and out of the stick pump assembly through the outlet.

In another independent embodiment, a stick pump assembly includes a tube having a first end, a second end, and an axis extending through the first and second ends, the tube accommodating fluid to flow therethrough; a pump coupled to the first end of the tube, the pump having an inlet in fluid communication with the tube; an outlet positioned adjacent the second end of the tube and in fluid communication with the tube; a filter assembly removably coupled to the pump and covering the inlet; and a clip coupled to the pump and the filter assembly to selectively secure the filter assembly to the pump.

In yet another independent embodiment, a stick pump assembly includes a tube having a first end, a second end, and an axis extending through the first and second ends, the tube accommodating fluid to flow therethrough; a pump including an impeller adjacent the first end and a motor operable for driving the impeller to draw fluid through the pump; a filter assembly coupled to the pump, the filter including an inner surface that at least partially defines a volute around the impeller; and an outlet in fluid communication with the tube.

In still another independent embodiment, a stick pump assembly includes a tube having a first end, a second end, and an axis extending through the first and second ends, the tube accommodating fluid to flow therethrough; a pump including an impeller adjacent the first end and a motor operable for driving the impeller to draw fluid through the pump; and a filter assembly coupled to the pump, the filter assembly including a sidewall having a top end adjacent the pump and a bottom end opposite the top end, a bottom wall coupled to the bottom end of the side wall, the bottom wall defining a plurality of apertures, and a top wall coupled to the top end of the side wall, the top wall defining a plurality of openings. Fluid can flow into the filter assembly through both the plurality of apertures and the plurality of openings.

Other independent aspects of the invention will become apparent by consideration of the detailed description, claims and accompanying drawings.

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways. Also, it is to be understood that the phraseology and terminology used herein is for the purpose of description and should not be regarded as limiting.

The use of "including", "comprising", or "having", and variations thereof herein, is meant to encompass the items listed thereafter and equivalents thereof as well as additional items. Unless specified or limited otherwise, the terms "mounted", "connected", "supported", and "coupled", and variations thereof, are used broadly and encompass both direct and indirect mountings, connections, supports, and couplings. Further, "connected" and "coupled" are not restricted to physical or mechanical connections or couplings.

DETAILED DESCRIPTION

Figure 1:
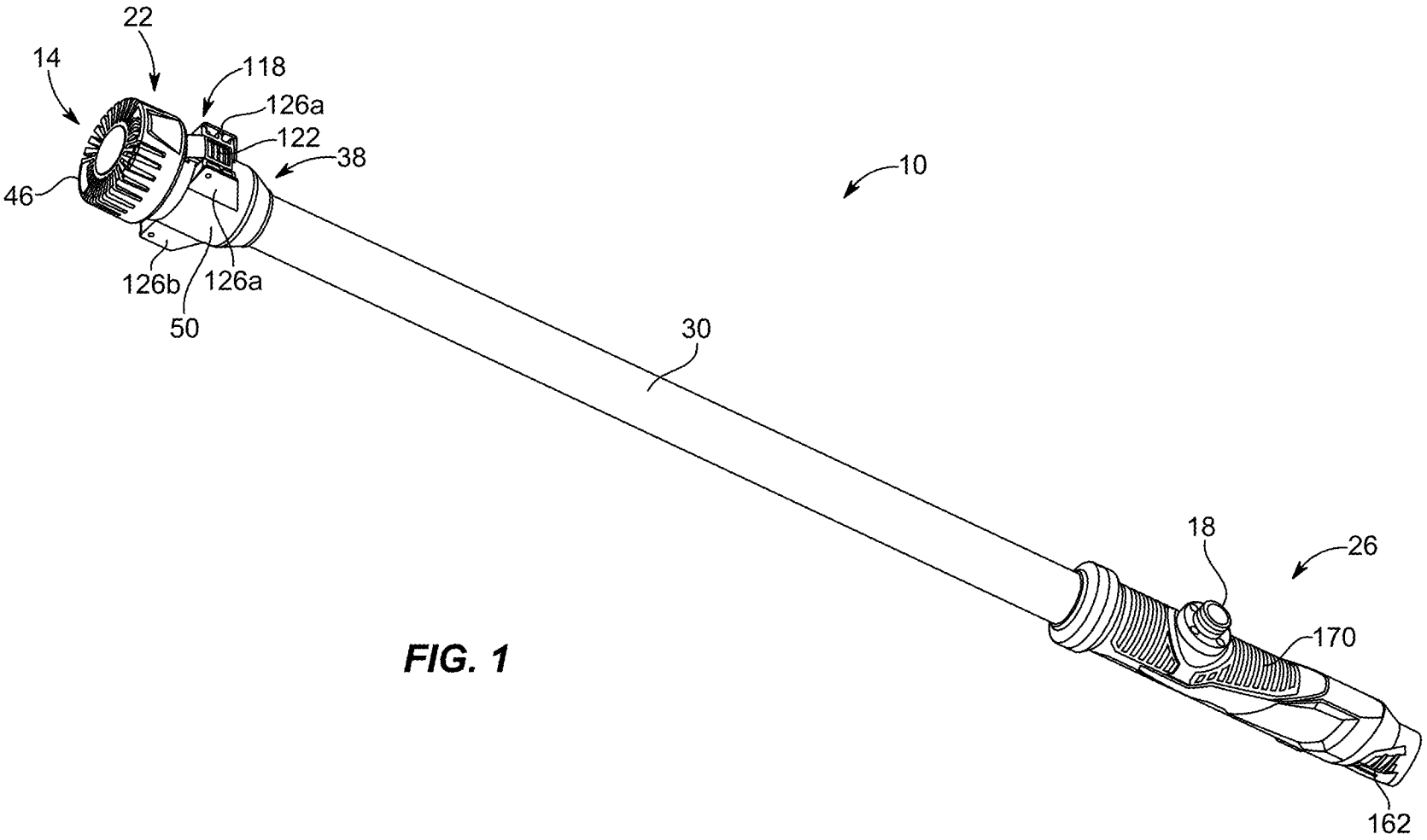
FIG. 1 is a perspective view of a stick pump assembly embodying the invention.

FIG. 1 illustrates a pump assembly 10 suitable to pump a fluid (e.g., water) from a first location (e.g., a clogged bathtub or another container of liquid) to a second location (e.g., a drain, another container, etc.) during a pumping operation. The pump assembly 10 is a transfer stick pump assembly 10 and is shaped and sized to pump fluid (e.g., water) from relatively tight spaces. In particular, the stick pump assembly 10 is advantageous for pumping water out of low, possibly hard to reach spaces, such as drainage ducts, submerged pumps, and/or the like.

Figure 2:
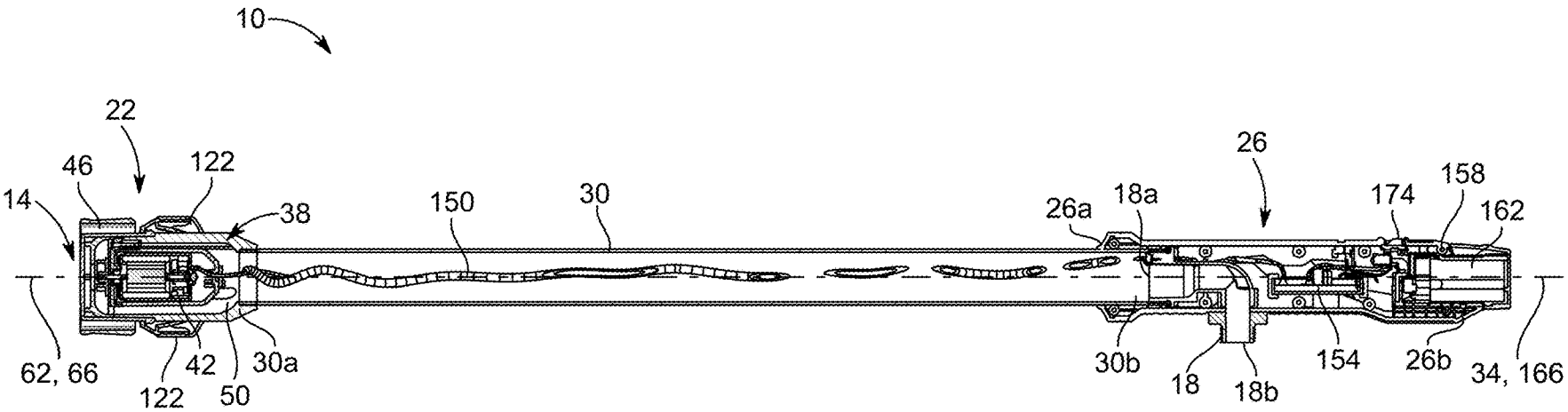
FIG. 2 is a cross-sectional view of the stick pump assembly of FIG. 1.

As shown in FIG. 1, the pump assembly 10 includes an inlet 14 for drawing liquid into the assembly 10 and an outlet 18 for discharging liquid away from the assembly 10. The outlet 18 may be coupled to an accessory (e.g., a hose) that carries the water away from the pump assembly 10 during operation. The pump assembly 10 further includes a first housing 22, a second housing 26, and an intermediate member 30 interconnecting the first housing 22 and the second housing 26. In the illustrated embodiment, the intermediate member 30 is configured as a tube 30 that accommodates fluid to flow therethrough. The tube 30, as shown in FIGS. 1 and 2, is elongated along an axis 34 (FIG. 2)—between a first end 30*a* and a second end 30*b*. Together, the first housing 22, the second housing 26, and the intermediate member 30 may be referred to as a housing assembly.

The inlet 14 is adjacent the first end 30*a* and positioned on the first housing 22, and the outlet 18 is adjacent the second end 30*b* positioned on the second housing 26. The axis 34 may be defined by the pump assembly 10 to be a central longitudinal axis 34 extending through the first housing 22, the intermediate member 30, and the second housing 26. During a pumping operation, the water flows into the first housing 22 via the inlet 14, travels through the intermediate member 30 and the second housing 26, and exits via the outlet 18. In other words, the inlet 14 and the outlet 18 are in fluid communication with each other through the tube 30 and in fluid communication with the tube 30.

As shown in FIG. 2, the first housing 22 houses a pump 38 having a motor 42 and an impeller 54. The first housing 22 may also be considered part of the pump 38. A filter assembly 46 is coupled to the pump 38 and, more particularly, the first housing 22. The pump 38 defines an inner housing 48, which houses the motor 42, and an outer housing 50 surrounding the inner housing 48. A chamber 52 is formed between an outer surface of the inner housing 48 and an inner surface of the outer housing 50. In some embodiments, the motor 42 is sealed in the inner housing 48 and fluidly separated from the chamber 52. In such embodiments, fluid within the chamber 52 would not contact the motor 42. The impeller 54 is supported on a motor output shaft 58, which defines a rotational axis 62. The illustrated rotational axis 62 is collinear with the longitudinal axis 34, but may alternatively be offset from or angled relative to the longitudinal axis 34. In the illustrated embodiment, the output shaft 58 extends into the chamber 52 from and through the inner housing 48, and the impeller 54 is coupled to the portion of the output shaft 58 that extends into the chamber 52. The impeller 54 is therefore positioned in the chamber 52.

Figure 6:
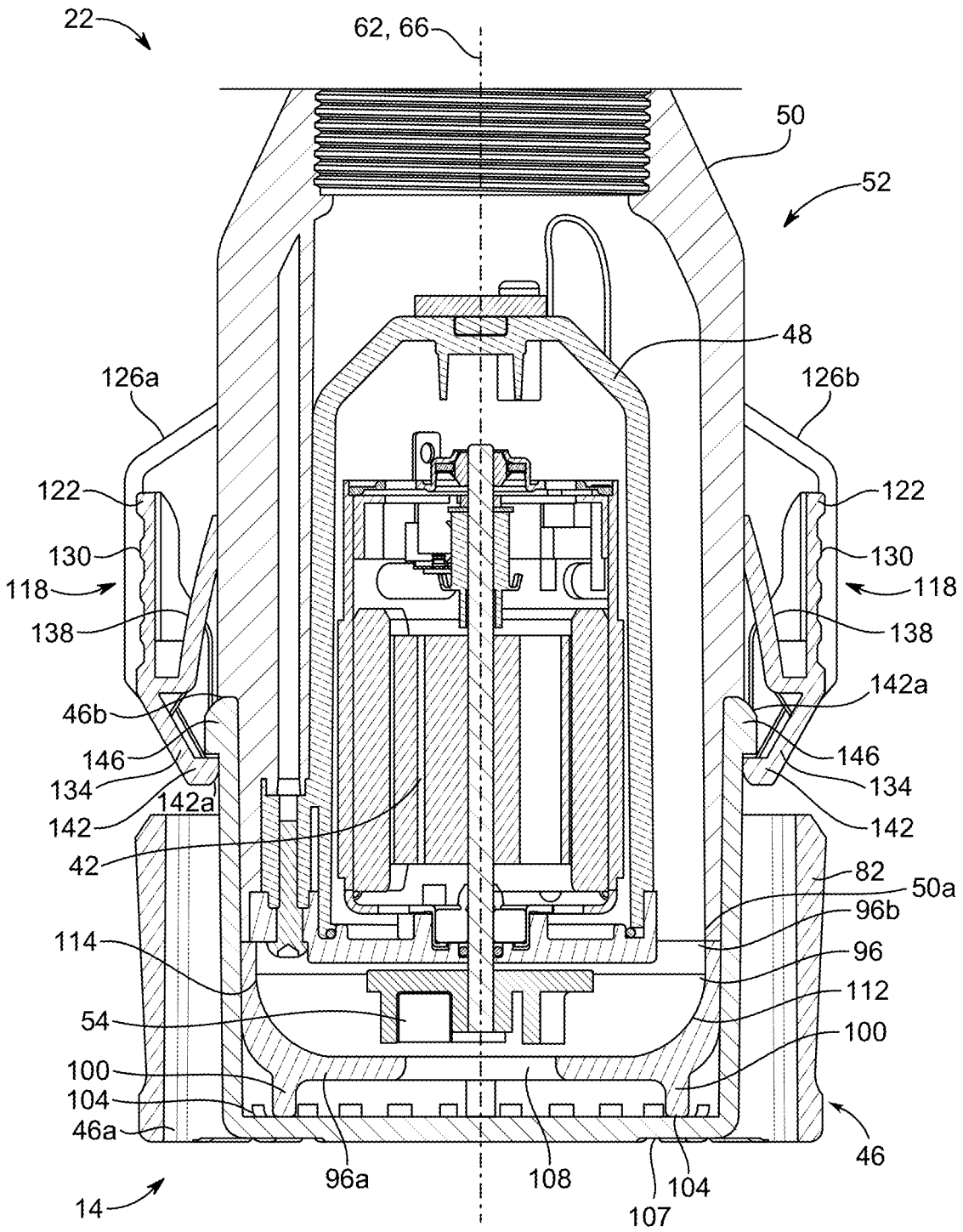
FIG. 6 is a cross-sectional view of the distal end of the stick pump assembly of FIG. 3, illustrating the filter assembly attached to the stick pump assembly.
Figure 9:
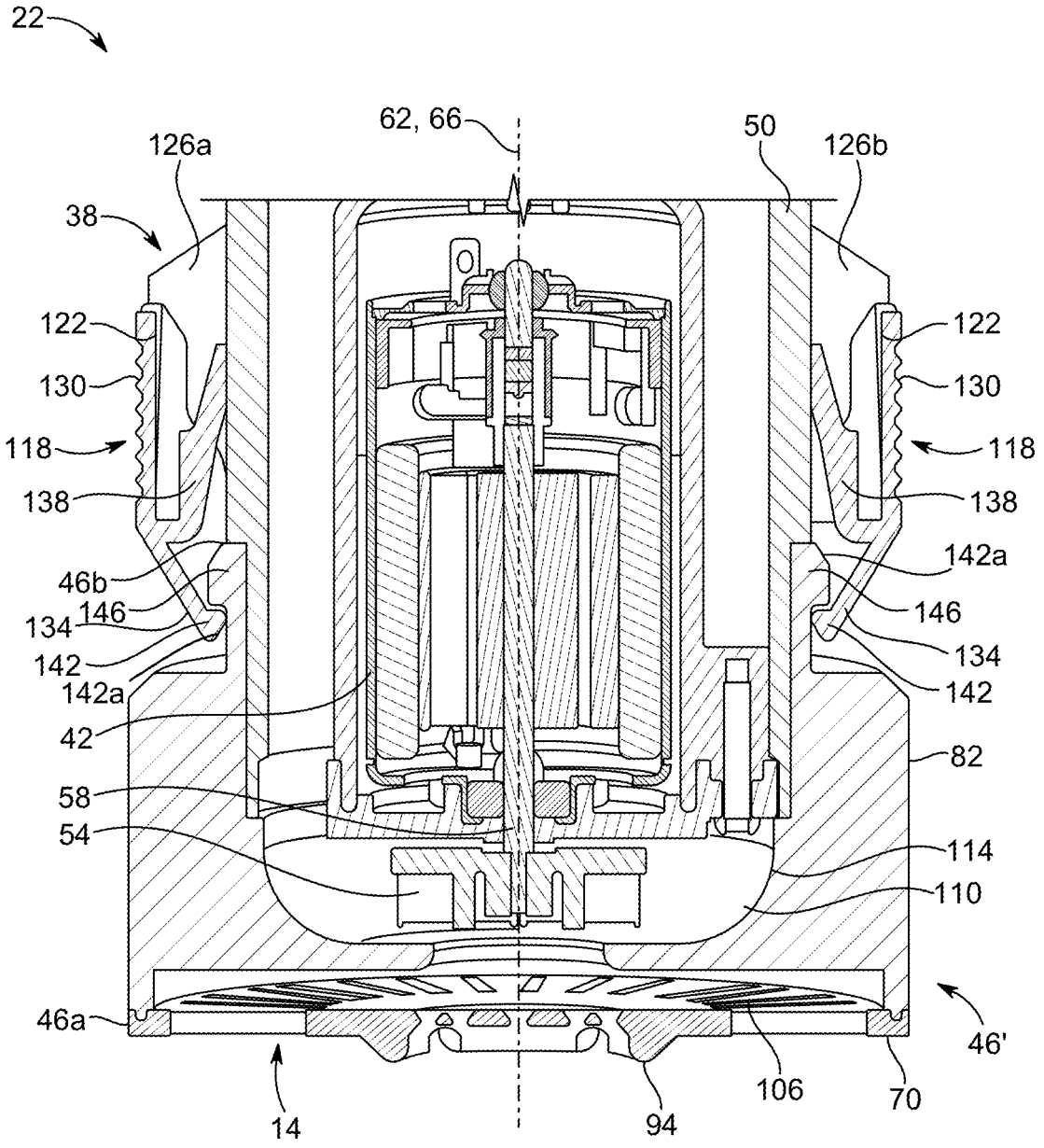
FIG. 9 is a cross-sectional view of the distal end of the stick pump assembly of FIG. 7.

As shown in FIGS. 6 and 9, the output shaft 58 directly drives the impeller 54 for rotation. The impeller 54 is rotatable in a first direction (e.g., clockwise) about the rotational axis 62 in order to draw fluid in through the inlet 14 and discharge fluid out the outlet 18. In the embodiment illustrated in FIG. 6, a cap 96 is coupled to a first end 48*a* of the inner housing 48, between the inner housing 48 and the impeller 54, thereby sealing the motor 42 within the inner housing 48.

Figure 7:
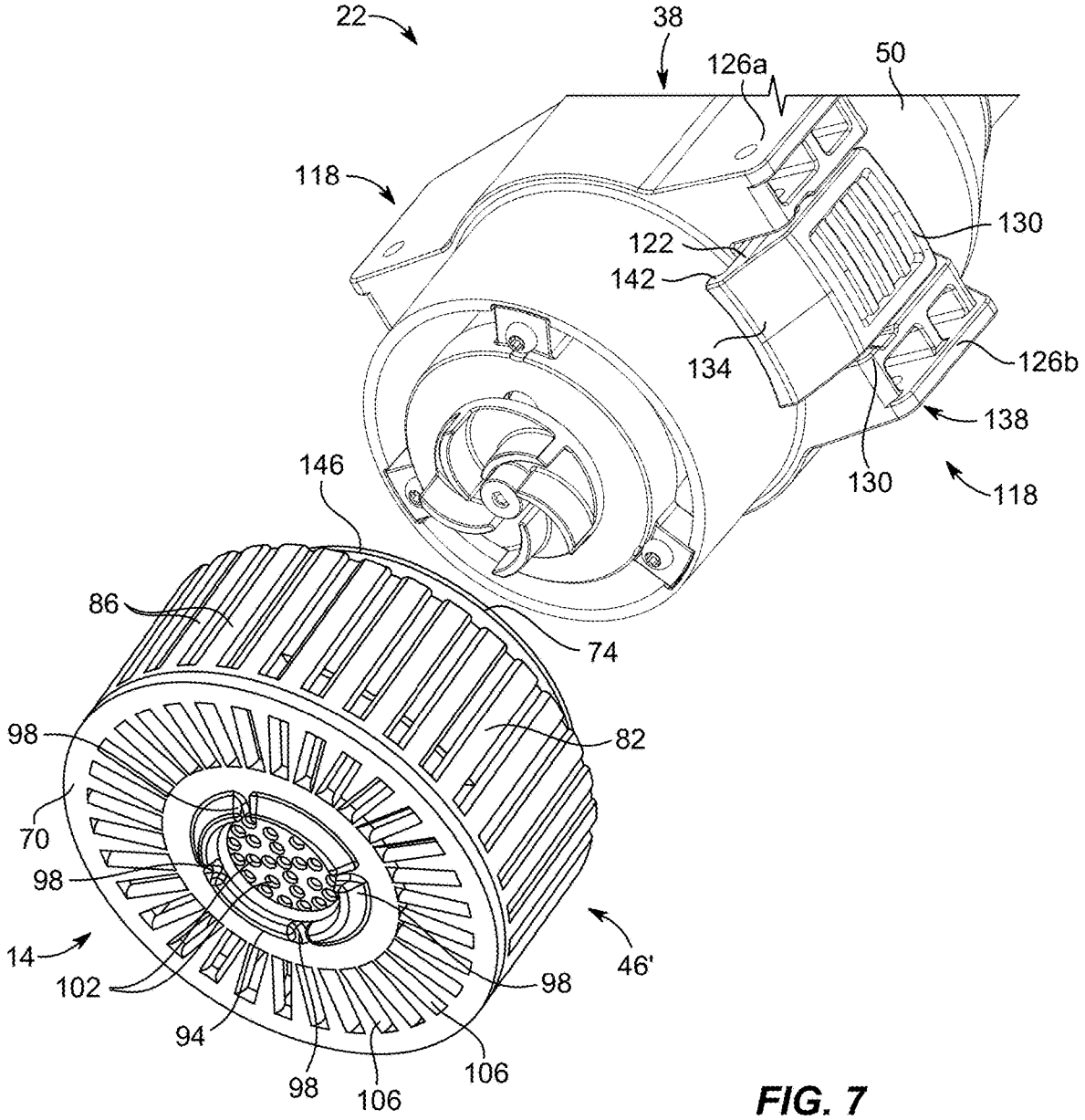
FIG. 7 is an enlarged perspective view of a distal end of the stick pump assembly of FIG. 1, illustrating another filter assembly separated from the stick pump assembly.
Figure 8:
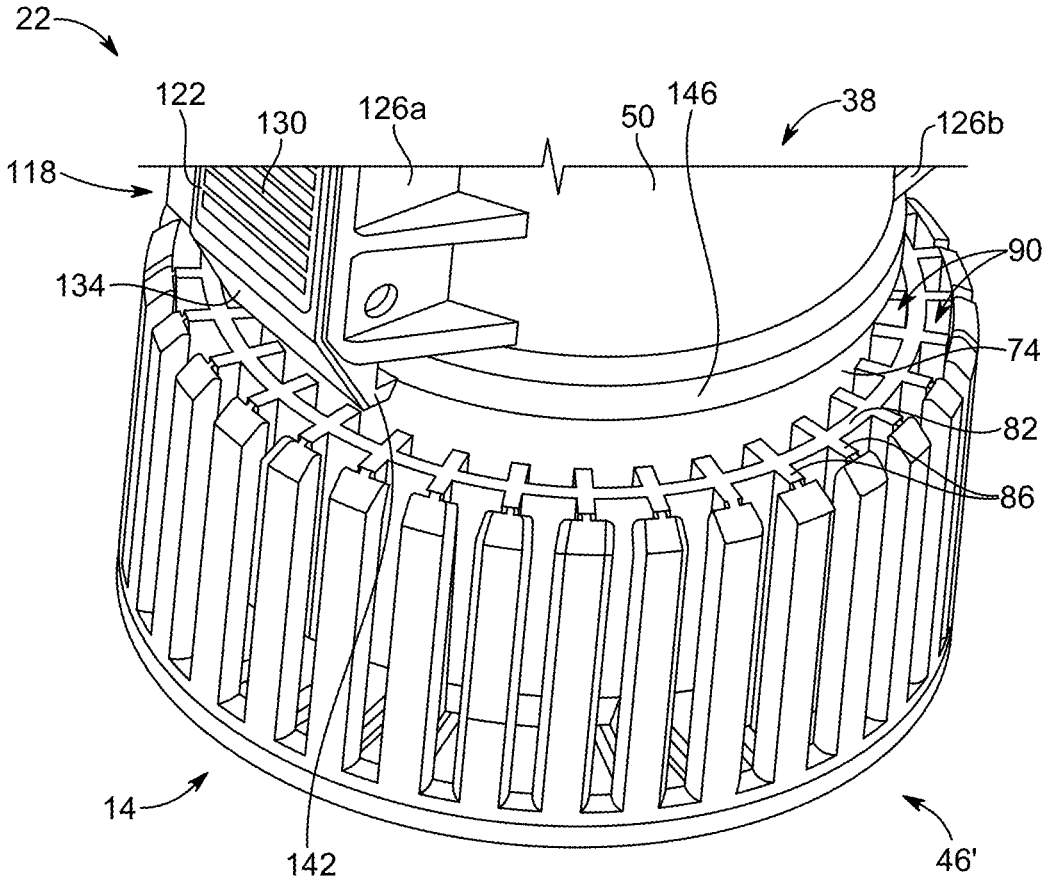
FIG. 8 is to perspective view of the filter assembly of FIG. 7.

With reference to FIGS. 3-6, the filter assembly 46 is removably coupled to the pump 38 and is supported thereby to at least partially cover the inlet 14. While FIGS. 1-6 illustrate the filter assembly 46, FIGS. 7-9 illustrate an alternate filter assembly 46' useable with the stick pump assembly 10. It should be understood that features and portions of the stick pump assembly 10 described herein are applicable to both filter assemblies 46, 46'. Some differences between the filter assemblies 46, 46' will be described in greater detail below. Specific features of the filter assembly 46' not described as different from the filter assembly 46 should be considered as like features.

Figure 3:
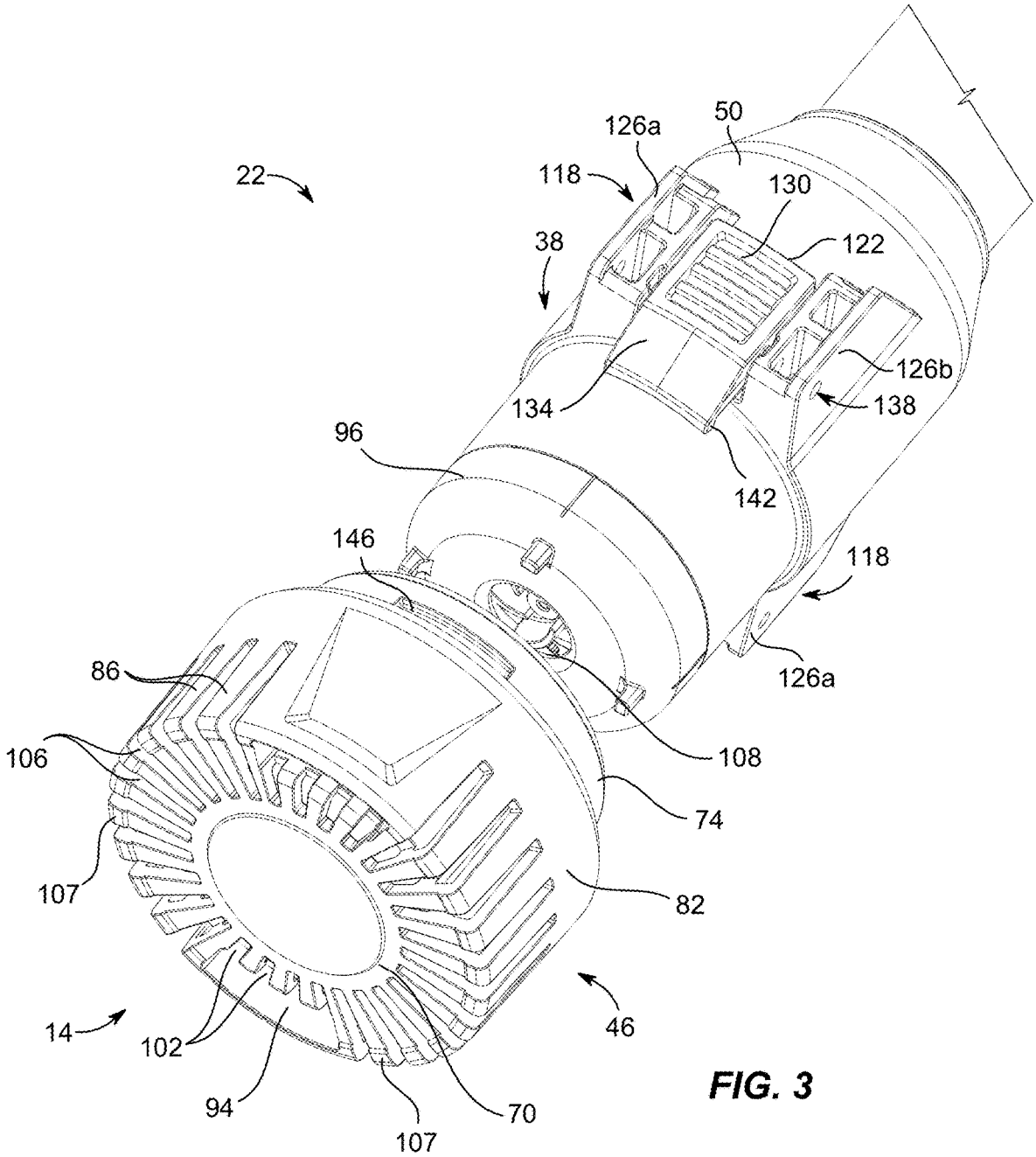
FIG. 3 is an enlarged perspective view of a distal end of the stick pump assembly of FIG. 1, illustrating a filter assembly separated from the stick pump assembly.
Figure 4:
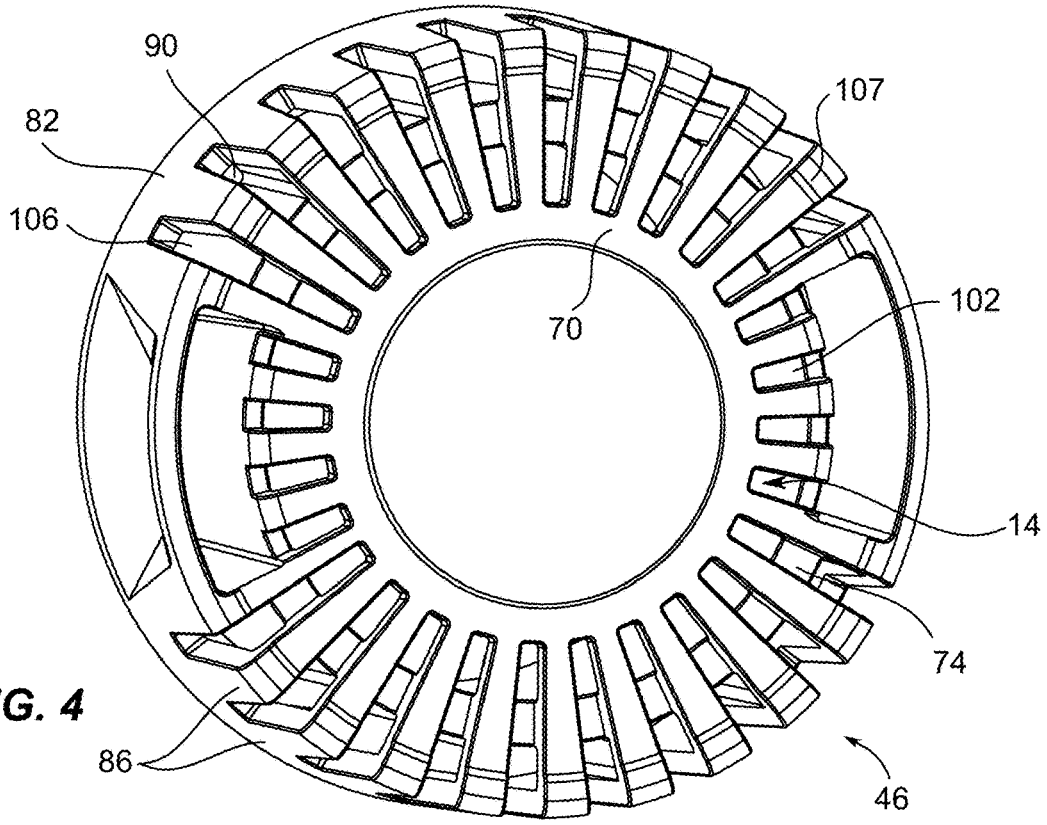
FIG. 4 is a bottom perspective view of the filter assembly of FIG. 3.
Figure 5:
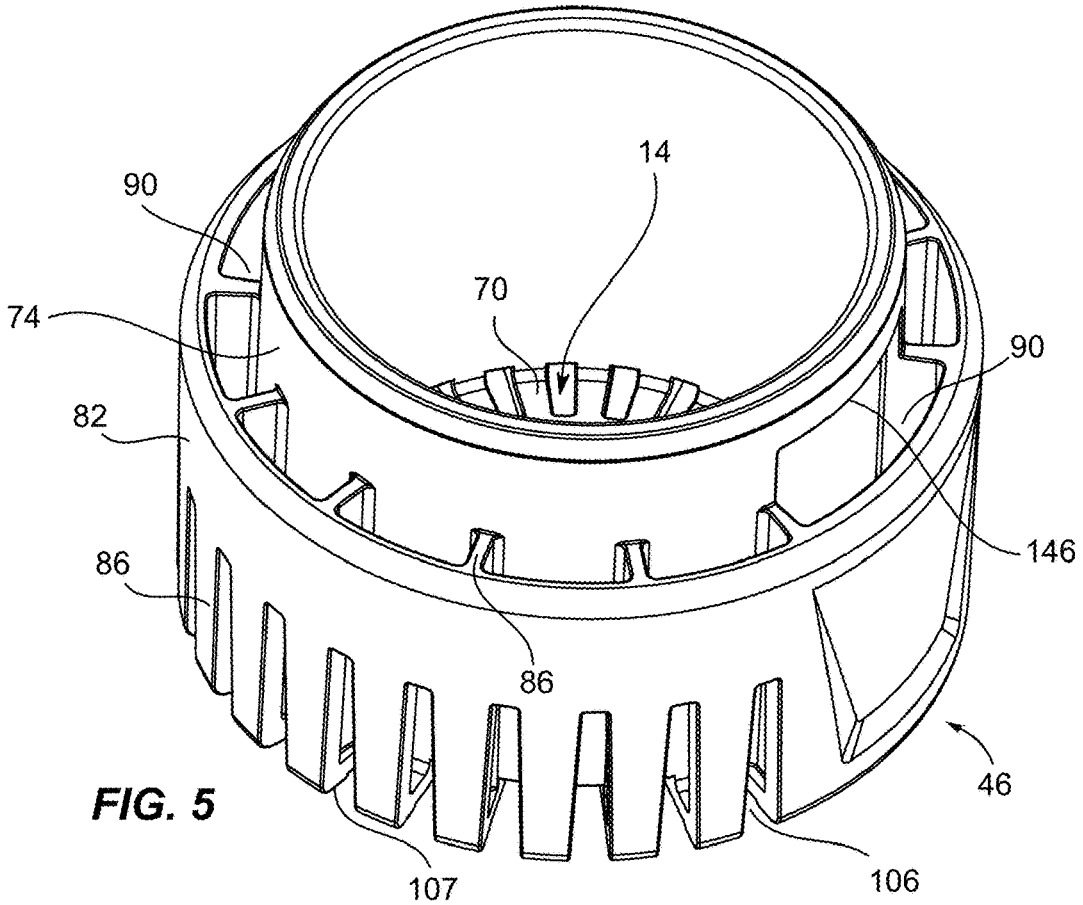
FIG. 5 is a top perspective view of the filter assembly of FIG. 3.

With reference to FIGS. 3-5, the illustrated filter assembly 46 is generally cylindrical and includes a first end 46*a*, a second end 46*b* opposite the first end 46*a*, and an axis (FIG. 2) extending through the first end 46*a* and the second end 46*b*. The axis 66 is parallel and colinear to the longitudinal axis 34 of the pump assembly 10 and the rotational axis 62 of the motor 42. The filter assembly 46 includes a first, bottom wall 70 adjacent the first end 46*a* and configured to engage a work surface, a main cylindrical wall 74 coupled to the first wall 70 and extending from the first end 46*a* to the second end 46*b*, and an opening formed in the second end 46*b*. The filter assembly 46 further includes an outer cylindrical wall 82 concentrically positioned around the periphery of the main cylindrical wall 74. The main cylindrical wall 74 and the outer cylindrical wall 82 together or separately may also be referred to as a side wall. In other embodiments, the filter assembly 46 may have other shapes, such as rectangular or hexagonal, and the walls 74, 82 may be shaped accordingly.

Ribs 86 circumferentially extend between the main cylindrical wall 74 and the outer cylindrical wall 82, thereby coupling the main cylindrical wall 74 and the outer cylindrical wall 82. The ribs 86 additionally extend outwardly from the outer cylindrical wall 82. Gaps are defined between adjacent ribs 86 around the circumference of the filter assembly 46, thereby forming openings 90 (FIG. 5) between the main cylindrical wall 74 and the outer cylindrical wall 82. The ribs 86 together may also form a second, top wall of the filter assembly 46. The openings 90 allow for water to enter the filter assembly 46 from the sides or from the top (e.g., adjacent the second end 46*b*) of the filter assembly 46. The openings 90 are further formed in the top end of the outer cylindrical wall 82. Therefore, in the event that the pump assembly 10 is placed on a work surface with obstructions (e.g., mud, debris, etc.), the water may enter the filter assembly 46 from the top via the openings 90.

With continued reference to FIGS. 3-5, a plurality of apertures including first apertures 102 and second apertures 106 extend through the bottom wall 70 to allow the passage of fluid (e.g., water) into the filter assembly 46. The first apertures 102 are shorter than the second apertures 106 and include a fewer number of apertures than the second apertures 106. The first and second apertures 102, 106 are generally rectangular and extend around a periphery of the bottom wall 70. More specifically, first and second apertures 102, 106 are circumferentially spaced around a central part of the bottom wall 70. In some embodiments, the wall 70 may include fewer or additional apertures and/or apertures of alternative shapes and sizes. A ridge 107 is coupled to and extends axially from the bottom wall 70. In the illustrated embodiment, the ridge 107 is formed at a perimeter of the bottom wall 70. The ridge 107 is separated into discrete parts by the second apertures 106. The ridge 107 helps space the remainder of the bottom wall 70 apart from a surface when the filter assembly 46 is pushed against the surface.

As shown in FIG. 5, the first apertures 102, the second apertures 106, and the openings 90 allow water to enter the filter assembly 46 through the first end 46*a* of the filter assembly 46, the second end 46*b* of the filter assembly 46, and the main wall 74. The apertures 102, 106 and openings 90 provide different passageways for the water to enter the filter assembly 46, while also catching debris, thereby reducing clogging and facilitating water flow into the filter assembly 46. In the illustrated embodiment, the first apertures 102 allow fluid to flow into the filter assembly 46 in a first axial direction, the openings 90 allow fluid to flow in a transverse radial direction, and the second apertures 106 allow fluid to flow in a second (e.g., opposite) axial direction.

As illustrated in FIGS. 3 and 6, a cap 96 is removably coupled to the pump 38 and/or filter assembly 46. An inner surface 112 of the cap 96 forms a curved surface, or volute 114. In such instances, an inner surface 110 of the filter assembly 46 is generally planar. A first end 96*a* of the cap 96 includes protrusions 100 including a similar shape and size to corresponding grooves 104 positioned on the inner surface 110 of the filter assembly 46. Therefore, the cap 96 may be selectively coupled and decoupled to the filter assembly 46. A cylindrical aperture 108 extends through the first end 96*a* of the cap 96. The aperture 108 allows for water flowing through the filter assembly 46 to flow into the cap 96. A second end 96*b* of the cap 96 is removably coupled to a first end 50*a* of the outer housing 50 of the motor 42. In some embodiments, the pump 38 is inoperable without the cap 96 coupled thereto.

Referring now to the alternate filter assembly 46' illustrated in FIGS. 7-9, the filter assembly 46' is generally cylindrical and includes a first end 46*a*, a second end 46*b* opposite the first end 46*a*, and an axis 66 extending through the first end 46*a* and the second end 46*b*. The axis 66 is parallel and colinear to the longitudinal axis 34 of the pump assembly 10 and the rotational axis 62 of the motor 42. The filter assembly 46' includes a first, bottom wall 70 adjacent the first end 46*a* and configured to engage a work surface, a main cylindrical wall 74 coupled to the first wall 70 and extending from the first end 46*a* to the second end 46*b*, and an opening formed in the second end 46*b*. The filter assembly 46' further includes an outer cylindrical wall 82 concentrically positioned around the periphery of the main cylindrical wall 74.

Ribs 86 circumferentially extend between the main cylindrical wall 74 and the outer cylindrical wall 82, thereby coupling the main cylindrical wall 74 and the outer cylindrical wall 82. The ribs 86 additionally extend outwardly from the outer cylindrical wall 82. Gaps are defined between adjacent ribs 86 around the circumference of the filter assembly 46', thereby forming openings 90 between the main cylindrical wall 74 and the outer cylindrical wall 82. The openings 90 allow for water to enter the filter assembly 46' from the sides or from the top (e.g., adjacent the second end 46*b*) of the filter assembly 46. Therefore, in the event that the pump assembly 10 is placed on a work surface with obstructions (e.g., mud, debris), the water may enter the filter assembly 46' from the top via the openings 90.

With reference to FIGS. 7 and 9, the bottom wall 70 includes a ridge 94 extending axially outwardly from the wall 70. The ridge 94 is generally circular and is positioned concentrically about the axis 66. The ridge 94 includes four grooves 98 extending into the ridge 94, thereby dividing the ridge 94 into four distinct, equal portions. In alternative embodiments, the ridge 94 may include fewer or additional grooves. Additionally, in alternative embodiments, the ridge 94 may include alternative shapes and sizes.

With continued reference to FIG. 7, a plurality of apertures including first apertures 102 and second apertures 106 extend through the bottom wall 70 to allow the passage of fluid (e.g., water) into the filter assembly 46. The first apertures 102 are circular and are positioned within the circumference of the ridge 94. The second apertures 106 are generally rectangular and extend around the periphery of the ridge 94. More specifically, the second apertures 106 are circumferentially spaced around ridge 94. In some embodiments, the wall 70 may include fewer or additional apertures and/or apertures of alternative shapes and sizes.

Because the ridge 94 extends axially outward from the first wall 70, the ridge 94 may contact the work surface during a pumping operation, and a gap is formed between a distal end of the ridge 94 and the first wall 70. The gap inhibits the first and second apertures 102, 106 from contacting the work surface, thereby facilitating suction of water into the filter assembly 46' and reducing clogging. Furthermore, the first apertures 102, the second apertures 106, and the openings 90 allow water to enter the filter assembly 46' through the first end 46*a* of the filter assembly 46', the second end 46*b* of the filter assembly 46', and the cylindrical wall 74. The apertures 102, 106 and openings 90 provide different passageways for the water to enter the filter assembly 46', while also catching debris, thereby reducing clogging and facilitating water flow into the filter assembly 46.

With reference to FIGS. 7 and 9, an inner surface 110 of the filter assembly 46' forms or defines the curved surface, or volute 114. When the filter assembly 46' is coupled to the pump housing 50, the output shaft 58 of the motor 42 extends into the filter assembly 46', such that the output shaft 58 and the impeller 54 are positioned within the volute 114. The volute 114 is generally ramped, or curved, in order to facilitate water flow during operation of the pump 38. More specifically, the volute 114, in conjunction with the rotating impeller 54, creates a suction environment (e.g., pressure difference, draw, or the like) that pushes water into the pump 38 and increases the velocity of the water as it travels through the first housing portion 22, the intermediate member 30, and the second housing portion 26. When the filter assembly 46' is removed from the pump housing 50, the impeller 54 does not generate enough suction force for the water to travel through the pump assembly 10. In other words, without a sealing effect from the volute 114, the impeller 54 cannot generate a strong enough suction force for the pump assembly 10 to function unhindered. Therefore, the pump assembly 10 is inoperable unless the filter assembly 46' is coupled to the pump housing 50.

Referring now to FIGS. 3 and 6, the filter assemblies 46, 46' are removably coupled to the housing 50 via a fastening mechanism 118. The illustrated fastening mechanism 118 includes two fasteners, or clips, 122 secured to the housing 50. One of the fasteners 122 is positioned between a first pair of flanges 126*a* extending from a first side of the housing 50, and the other of the fasteners 122 is positioned between a second pair of flanges 126*b* extending from a second side of the housing 50 substantially opposite from the first pair of flanges 126*a*. Each of the fasteners 122 is movable (e.g., pivotable) between a first position, where the fastener 122 is engaged with the filter assembly 46, 46', and a second position, where the fastener 122 is disengaged from the filter assembly 46, 46'. The fasteners 122 are independently movable between the engaged and disengaged positions by a user, and, in the illustrated embodiment, are moveable without the need of an additional tool (e.g., a screwdriver, wrench, etc.).

Each of the fasteners 122 includes an actuator 130, an engaging portion 134 obliquely oriented relative to the actuator 130, and a biasing portion 138. The actuator 130 includes a surface operable to be engaged by the user in order to move the fastener 122 from the engaged position to the disengaged position. The engaging portion 134 includes a hook 142 configured to engage a corresponding lip 146 on the filter assembly 46, 46'. As best illustrated in FIGS. 6 and 9, the lip 146 includes a ramped surface 146*a* that engages a complementary ramped surface 142*a* of the clip 122 to temporarily rotate the hook 142 away from the lip 146.

The biasing portion 138 is positioned adjacent to the actuator 130 and is coupled to the housing 50. The biasing portion 138 biases the engaging portion 134, and therefore the fastener 122 into the engaged position, such that the hook 142 engages the lip 146. In the illustrated filter assembly 46' of FIG. 7, the lip 146 extends circumferential around the filter assembly 46, but could be a discrete lip (e.g., extending around a portion of the filter assembly 46) in some embodiments. In the illustrated filter assembly 46 of FIG. 3, the lip 146 is recessed into the main wall 74 has a size and shape similar to the engaging portion 134.

In order to move the fastener 122 to the disengaged position, a user can depress the actuator 130 against the bias of the biasing member or biasing portion 138 (e.g., toward the housing 50), thereby pivoting the engaging portion 134 away from the lip 146. While maintaining pressure on the actuator 130, the user may then move the filter assembly 46, 46' away from the housing 50 and then release the actuator 130. The user may selectively remove the filter assembly 46, 46' from the housing 50 in order to clean or replace the filter assembly 46 after extensive use.

In alternative embodiments, the fastening mechanism 118 may include different configurations. For example, the fastening mechanism 118 may only include a single fastener 122 or may include more than two fasteners 122. In other embodiments, the housing 50 and the filter assembly 46 may be removably coupled together via different mechanisms, such as a threaded connection, a quick-connect coupler, a bayonet-style coupling, thumb screws, magnets, screws, and the like.

With reference to FIGS. 1-2, the intermediate member 30 is secured to the first housing 22 (e.g., pump 38) and the second housing 26 (e.g., handle 56). In the illustrated embodiment, the intermediate member 30 is threadably coupled to the first housing 22 and the second housing 26. Specifically, the first end 30*a* of the intermediate member 30 is threadably coupled to the housing 50, and the second end 30*b* of the intermediate member 30 is threadably coupled to a handle 56 defined by the second housing 26. In some embodiments, the intermediate member 30 may be coupled to the first and second housings 22, 26 via different mechanisms (e.g., fasteners). The intermediate member 30 is generally cylindrical and hollow. Wires 150 or other conductors extend through the tube 30 from the motor 42 to a battery receptacle 158 in the handle 56 on the second housing 26. The wires 150 include a waterproof seal, insulation, or casing, to inhibit damage to the wires 150 when water flows through the intermediate member 30.

With reference to FIG. 2, the second housing 26, particularly the handle 56, includes the outlet 18, a printed circuit board (PCB) 154, and the battery receptacle 158. The outlet 18 is positioned on a first end 26*a* of the second housing 26. The outlet 18 includes a curved tube positioned within the second housing 28. A first end 18*a* of the outlet 18 is threadably coupled to the second end 30*b* of the intermediate member 30, and a second end 18*b* of the outlet 18 extends through a side of the second housing portion 26.

With continued reference to FIG. 2, the battery receptacle 158 is positioned on a second end 26*b* of the second housing member 26 and is configured to at least partially receive a removable battery pack 162. The battery pack 162 is received within the receptacle 158 along an insertion axis 166 that is parallel and collinear with the longitudinal axis 34. In the illustrated embodiments, the battery pack 162 is an interchangeable and rechargeable power tool battery pack and is connected to the PCB 154. The battery pack 162 may include one or more battery cells. For example, the battery pack 162 may be a 12-volt battery pack and may include three (3) Lithium-ion battery cells. In other constructions, the battery pack 162 may include fewer or more battery cells such that the battery pack is a 14.4-volt battery pack, an 18-volt battery pack, or the like. Additionally or alternatively, the battery cells may have chemistries other than Lithium-ion such as, for example, Nickel Cadmium, Nickel Metal-Hydride, or the like.

An outer periphery of the handle 56 forms a grip 170 graspable by the user during operation. An actuator, or trigger, 174 is supported by the second housing portion 26. The trigger 174 is actuatable by the user to selectively power the motor 42.

In operation, the user positions the inlet 14 (e.g., the filter assembly 46) on the work surface that includes fluid (e.g., water) to be transferred. The outlet 18 is connected to a tube or conduit (not shown) that is placed at the desired output location for the fluid. The pump assembly 10 is positioned generally upright, such that the longitudinal axis 34 of the assembly 10 is generally perpendicular to the work surface. The first housing portion 22 is generally compact, such that the pump assembly 10 may dispose of water in generally tight spaces. Upon activation of the trigger 174, the motor 42 and the pump 38 are activated, causing rotation of the impeller 54. The pump 38 pulls fluid generally upwards, through the filter assembly 46, into the pump 38, through the tube 30, through the outlet 18, and out of the stick pump assembly 10.

Specifically, the water enters the filter assembly 46 via the openings 90, the first apertures 102, and the second apertures 106. The volute 114 and the impeller 54 generate a suction force, which pushes the water into the pump 38 at a sufficient velocity, such that the water flows upwards through the intermediate member 30 and exit the assembly 10 via the outlet 18.

During operation of the pump assembly 10, the water moves along a flow path. Specifically, the water flows into the filter assembly 46 via the openings 90, the first apertures 102, and the second apertures 106. The water then flows through the cylindrical aperture 108 of the cap 96 and into the cap 96. The water flows upwards, towards the intermediate member 30, through the chamber 52 formed between the inner motor housing 48 and the outer motor housing 50. The water exits the chamber 52 and flows upwards into the intermediate member 30, and travels from the first end 30*a* of the intermediate member 30 to the second end 30*b* of the intermediate member 30. Once the water reaches the second end 30*b* of the intermediate member 30, the water flows through the outlet 18 and out of the pump assembly 10.

Figure 10:
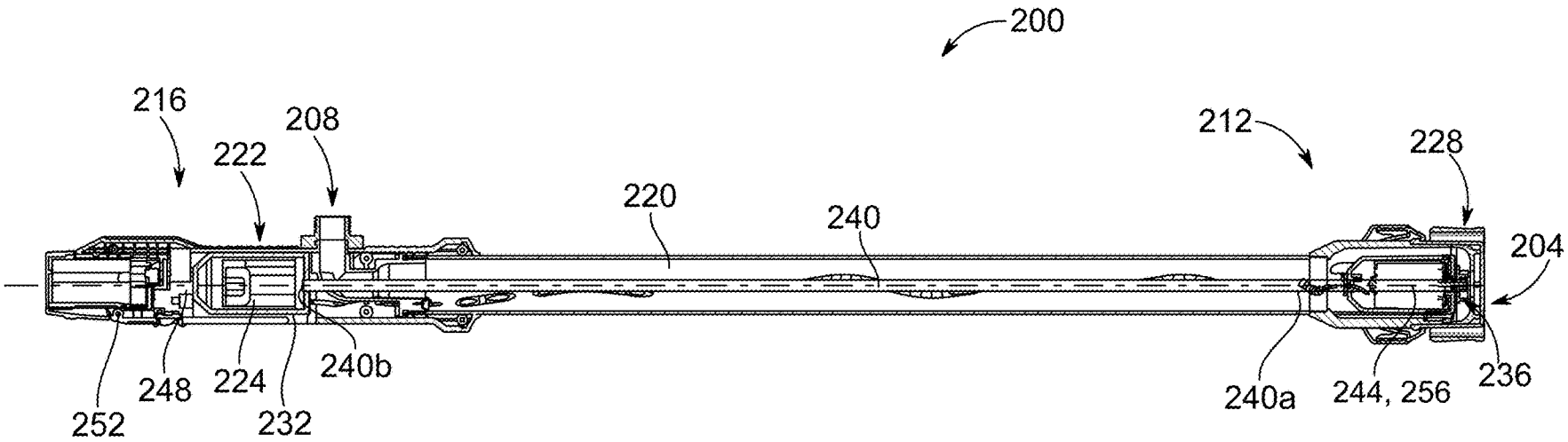
FIG. 10 is a cross-sectional view of another stick pump assembly embodying the invention.

FIG. 10 illustrates another pump assembly 200. The illustrated pump assembly 200 is similar to the pump assembly 10 described above and includes like parts. Reference is hereby made to the description of the pump assembly 10 shown in FIGS. 1-5 for description of features and elements of the pump assembly 200 not specifically included below.

The illustrated pump assembly 200 includes an inlet 204 for drawing liquid into the assembly 200 and an outlet 208 for discharging liquid away from the assembly 200. The pump assembly 200 further includes a first housing 212, a second housing 216, and an intermediate member 220 interconnecting the first housing 212 and the second housing 216. The inlet 204 is positioned on the first housing 212. The outlet 208 is positioned on the second housing 216. During a pumping operation, the water flows into the first housing 212 via the inlet 204, travels through the intermediate member 220 and the second housing 216, and exits via the outlet 208.

With continued reference to FIG. 10, the pump assembly 200 includes a pump 222 having a motor 224 and an impeller 236, and a filter assembly 228. In the illustrated embodiment, the motor 224 is remote from the impeller 236. Specifically, the pump 222 defines a housing 232, which houses the motor 224. The impeller 236 is coupled a motor output shaft 240 extending from the motor 224 and defining a rotational axis 244. The impeller 236 is rotational in a first direction (e.g., clockwise) about the rotational axis 244 in order to draw fluid in through the inlet 204 and discharge fluid out the outlet 208. In the illustrated embodiment, the impeller 236 and the filter assembly 228 are positioned in the first housing 212 and the motor 224 is positioned in the second housing 216. The second housing 216 includes the outlet 208, the pump 222, the motor 224, a printed circuit board (PCB) 248, and a battery receptacle 252.

The motor output shaft 240 extends along the intermediate member 220 between the impeller 236 and the motor 224. Specifically, a first end 240*a* of the motor output shaft 240 is coupled to the impeller 236 and a second end 240*b* of the motor output shaft 240 is coupled to the motor 224, such that the motor output shaft 240 couples the impeller 236 to the motor 224. The motor output shaft 240 transmits torque to the impeller 236 during operation. The motor output shaft 240 defines the rotational axis 244, which is collinear with a longitudinal axis 256 of the pump assembly 200. The motor output shaft 240 directly drives the impeller 236 for rotation.

In operation, the user positions the inlet 204 (e.g., the filter assembly 228) on the work surface that includes fluid (e.g., water) to be transferred. The outlet 208 is connected to a tube or conduit (not shown) that is placed at the desired output location for the fluid. Upon activation of a trigger, the motor 224 and the pump 222 are activated, causing rotation of the impeller 236. The pump 222 pulls fluid generally upwards, through the filter assembly 228. A volute of the filter assembly 228 and the impeller 236 generate a suction force, which pushes the water into the pump 222 at a sufficient velocity, such that the water flows upwards through the intermediate member 220 and exits the assembly 200 via the outlet 208. Because the motor 224 and the PCB 248 are positioned in the second housing 216, they have limited contact with the water, thereby protecting the motor 224 and PCB 248 from water damage.

Although the invention has been described in detail with reference to certain preferred embodiments, variations and modifications exist within the scope and spirit of one or more independent aspects as described.

What is claimed is:

1. A stick pump assembly comprising:

a tube having a first end, a second end, and an axis extending through the first end and the second end, the tube accommodating fluid to flow therethrough;

a pump including a motor and an impeller, the pump having an inlet adjacent the first end and in fluid communication with the tube;

a chamber surrounding the pump, the chamber being fluidly separated from the motor; and a handle including:

an outlet adjacent the second end and in fluid communication with the tube, a receptacle configured to receive a battery pack, and a grip formed by an outer periphery of the handle, the grip configured to be grasped by a user during operation of the stick pump assembly;

wherein the outlet and the grip are positioned along the axis between the tube and the receptacle; and wherein fluid flows into the stick pump assembly through the inlet, around the motor, through the tube, and out of the stick pump assembly through the outlet.

2. The stick pump assembly of claim 1, wherein the pump includes an inner housing surrounding the motor and an outer housing surrounding the inner housing, and wherein the chamber is defined between the inner housing and the outer housing.

3. The stick pump assembly of claim 2, wherein the motor includes an output shaft extending into the chamber, and wherein the impeller is coupled to the output shaft and positioned in the chamber.

4. The stick pump assembly of claim 3, wherein the fluid flowing into the stick pump assembly through the inlet flows through the chamber, and wherein the motor is sealed within the inner housing and fluidly separated from the chamber.

5. The stick pump assembly of claim 1, wherein the grip is located at least partially between the outlet and the receptacle.

6. The stick pump assembly of claim 5, wherein the grip extends along the axis on both sides of the outlet.

7. The stick pump assembly of claim 1, wherein the handle includes an actuator configured to be actuated by the user to selectively power the stick pump assembly, and wherein the grip is located between the actuator and the tube.

8. A stick pump assembly comprising:

a tube having a first end, a second end, and an axis extending through the first end and the second end, the tube accommodating fluid to flow therethrough;

a battery receptacle supported by the tube and configured to receive a battery pack;

a pump including an impeller and a motor operable for driving the impeller to draw fluid through the pump, the pump having an inlet in fluid communication with the tube;

an outlet in fluid communication with the tube;

a chamber surrounding the pump, the chamber being fluidly separated from the motor; and a filter assembly covering the inlet such that, in operation, fluid is drawn past the filter assembly and into the chamber, the filter assembly including a bottom wall at an end of the stick pump assembly opposite of the battery receptacle;

wherein the bottom wall includes a ridge, the ridge separating a first plurality of apertures formed through the bottom wall from a second plurality of apertures formed through the bottom wall, the first plurality of apertures being different in cross section from the second plurality of apertures.

9. The stick pump assembly of claim 8, wherein each of the first plurality of apertures is generally circular in cross section.

10. The stick pump assembly of claim 9, wherein the second plurality of apertures is spaced circumferentially about the axis.

11. The stick pump assembly of claim 10, wherein each of the second plurality of apertures is, in cross section, longer in a direction extending away from the axis than in a width extending circumferentially about the axis.

12. The stick pump assembly of claim 8, wherein the ridge is generally circular and extends circumferentially about the axis.

13. The stick pump assembly of claim 12, wherein the filter assembly includes a side wall adjacent the bottom wall, and wherein the side wall includes a third plurality of apertures.

14. The stick pump assembly of claim 13, wherein the third plurality of apertures is different in cross section than both the first plurality of apertures and the second plurality of apertures.

15. A stick pump assembly comprising:

a tube having a first end, a second end, and an axis extending through the first end and the second end, the tube accommodating fluid to flow therethrough;

a housing receiving the second end of the tube;

an outlet in fluid communication with the tube and located adjacent the second end of the tube;

an outlet tube positioned at least partially within the housing and fluidly connecting to the tube to the outlet;

a pump adjacent the first end of the tube and configured to draw fluid into the tube and through the outlet, and a conductor connected to the pump and positioned within an interior of the housing, and wherein the outlet tube is configured to maintain fluid separation between fluid within the outlet tube and the interior of the housing.

16. The stick pump assembly of claim 15, wherein the outlet tube is threadably coupled to the tube.

17. The stick pump assembly of claim 16, wherein the outlet tube extends from within the housing to outside of the housing.

18. The stick pump assembly of claim 15, wherein the outlet tube directs fluid exiting the tube in a direction orthogonal to the axis.

19. The stick pump assembly of claim 18, wherein a fluid flowpath within the outlet tube curves to the direction orthogonal to the axis.

* * * * *